US007726613B2

(12) United States Patent
Burnier et al.

(10) Patent No.: US 7,726,613 B2
(45) Date of Patent: Jun. 1, 2010

(54) WATER BLAST GUN SUPPORT APPARATUS AND METHODS

(75) Inventors: Timothy A. Burnier, Sleepy Hollow, IL (US); George E. Radcliffe, Villa Park, IL (US); Steven C. Bast, Lombard, IL (US)

(73) Assignee: Park Technologies, L.L.C., Sleepy Hollow, IL (US)

( * ) Notice: Subject to any disclaimer, the term of this patent is extended or adjusted under 35 U.S.C. 154(b) by 951 days.

(21) Appl. No.: 11/350,390

(22) Filed: Feb. 8, 2006

(65) Prior Publication Data

US 2006/0260823 A1 Nov. 23, 2006

Related U.S. Application Data

(60) Provisional application No. 60/650,839, filed on Feb. 8, 2005.

(51) Int. Cl.
*A47F 5/00* (2006.01)

(52) U.S. Cl. ..... 248/123.11; 248/121; 248/123.2; 248/124.1; 169/24; 169/30; 169/51

(58) Field of Classification Search ..... 169/24, 169/30, 51; 248/121, 123.11, 123.2, 124.1
See application file for complete search history.

(56) References Cited

U.S. PATENT DOCUMENTS

| | | | | |
|---|---|---|---|---|
| 3,531,054 | A | 9/1970 | Pulk | |
| 3,565,372 | A | 2/1971 | Jones et al. | |
| 3,604,627 | A | 9/1971 | Miscovich et al. | |
| 3,917,200 | A * | 11/1975 | Johnson | 248/647 |
| 3,982,715 | A | 9/1976 | Lindgren et al. | |
| 4,265,147 | A | 5/1981 | Fox | |
| 4,615,487 | A * | 10/1986 | O'Brien et al. | 239/281 |
| 4,690,328 | A | 9/1987 | Roehl | |
| 4,947,492 | A * | 8/1990 | Vincent | 4/420 |
| 5,217,344 | A | 6/1993 | Gendrault et al. | |
| 5,305,713 | A * | 4/1994 | Vadakin | 122/391 |
| 5,823,218 | A | 10/1998 | Schlecht et al. | |
| 5,833,762 | A | 11/1998 | Wanner et al. | |
| 6,789,755 | B1 | 9/2004 | Mack et al. | |
| 6,811,188 | B2 * | 11/2004 | Haviland | 285/272 |
| 2002/0157690 | A1 * | 10/2002 | Tebbe | 134/58 R |
| 2004/0108003 | A1 | 6/2004 | Schwing et al. | |

OTHER PUBLICATIONS

International Search Report for PCT/US 06/04356, mailed on Sep. 5, 2007 in 10 pages.

* cited by examiner

*Primary Examiner*—Michael Barr
*Assistant Examiner*—Benjamin Osterhout

(57) ABSTRACT

A water blast gun support apparatus and methods for enabling the operator to direct the gun by a joystick attached to a pneumatic sinusoidal biasing control unit. Depending upon the direction the joystick is pointed by the operator, a controlled flow of air is delivered to pneumatic motion producing actuators which move the water blast gun to the desired position and maintain this position when the operator moves the joystick to its neutral position. The support apparatus absorbs the thrust of the water so that the operator is relieved from having to physically counter the force of the water.

25 Claims, 20 Drawing Sheets

WATER BLAST GUN SUPPORT APPARATUS AND METHODS

CROSS-REFERENCE TO RELATED APPLICATIONS

This application claims priority under 35 U.S.C. §119(e) to U.S. Provisional application Ser. No. 60/650,839 filed on Feb. 8, 2005, the entire content of which is hereby incorporated by references.

FIELD OF THE INVENTION

This invention relates generally to portable and stationary support apparatus and methods for water blast guns and, more particularly, water blast gun support apparatus and methods for industrial and commercial cleaning such as cleaning exterior building wall surfaces, water towers, the interior and exterior of storage tanks, heat exchange tubes, ships, automotive paint lines and fixtures, etc.

BACKGROUND OF THE INVENTION

Water blast cleaning guns are used to clean exterior walls and the like. These guns are typically carried by and manually operated by a person. Operating such a gun is an especially fatiguing occupation since the user must constantly direct the blast while physically countering the force of the water or be is knocked backward by its force. Such fatigue often adversely affects the operator's ability to concentrate on directing the water blast at the surface that needs to be cleaned.

SUMMARY OF THE INVENTION

This invention is a portable or stationary support apparatus to which a water blasting gun is attached wherein the operator directs the gun by a joystick coupled to a positioning and control system. This apparatus absorbs the thrust of the water so that the operator of the gun is relieved from having to physically counter this force. This water blast gun apparatus and methods prevent the operator from being knocked backwards and injured by the thrust of the water, substantially reducing operator fatigue, substantially increasing his ability to concentrate on directing the water blast at the surface that needs to be cleaned, and allowing him to much more precisely maintain the water blast on a particular target.

In one embodiment, the joystick controls a pneumatic sinusoidal biasing control unit. Depending upon the direction the joystick is pointed by the operator, a controlled flow of air is delivered to pneumatic actuators which move a gun support arm to the desired position and maintain its position there.

This apparatus and methods advantageously provide the operator with a full range of motion while giving the operator full-time control as to where the operator points the gun and how much thrust the operator wants to feel. As a result, the operator has the same or better control of the water blast gun than the operator would by manually holding the blast gun plus the substantial advantage of not having to both support the weight of the gun and hose and exert an equal but opposite thrust to that created by the water blasting out of the gun.

DETAILED DESCRIPTION OF THE PREFERRED EMBODIMENTS

Figure 1:
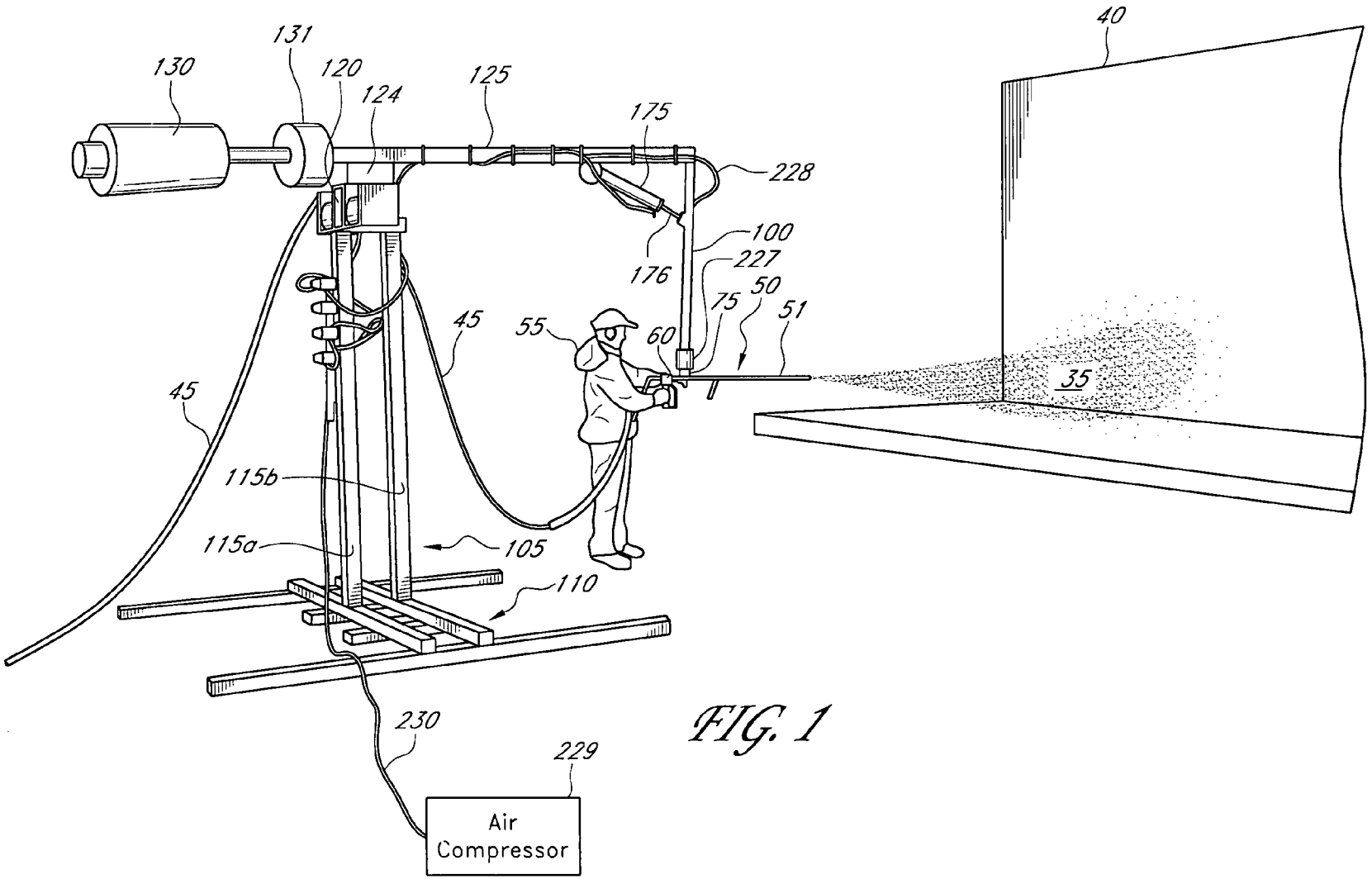
FIG. 1 is a perspective view of one embodiment of the water blast gun apparatus being used to clean the wall of a building.

FIG. 1 illustrates an embodiment of the water blast apparatus, applying a high pressure e.g., 10,000 to 40,000 psi, blast of water 35 against the wall 40 of an exterior building. The water is delivered under high pressure through hose 45 to a water blasting gun 50.

Operator 55 is enabled to both easily control the direction of gun 50 and maintain its position. It will be understood that water guns under high pressures of the order of 10,000 psi and above are extremely difficult to control because the large thrust force produced by the high pressure water must be countered by an equal manual force provided by the operator. Even a very physically strong operator will soon become fatigued operating high thrust water blast guns. A feature of the preferred embodiment is that the water thrust force is absorbed by the apparatus and not the operator 55. As a result, the operator has real time control as to where he or she points the gun 50 and can have as much or little thrust to counter as the operator wants to feel.

A trigger operated flow control valve 60 (shown being operated by the operator's right hand) is connected between the end of water hose 45 and the barrel 51 of gun 50. The operator uses valve 60 to turn on and off the flow of water.

The operator's left hand grasps a joystick 75 to position the gun 50. Joystick 75 controls a pneumatic control system that positions the control arm 100 attached to and supporting gun 50. This system includes control unit 227. Air flow hose 230 connects unit 227 to an air compressor 229 supplying air under pressure to unit 227. Controlled air flows out of unit 227 are sent over plural air hose 228 to motion producing actuators 175 and at 120 as described below to drive the control arm 100. Other pneumatic control devices, such as pilot-operated regulators and/or valves to allow for larger volumes of air to pressurize the actuators quickly, can be used to provide the operator with more instantaneous response. Such devices are coupled between the joystick and the motion producing actuators driving control arm 100. These pilot-operated regulators and/or valves can be exchanged for smaller or larger capacity units, as requirements for more or less air flow dictate.

Control arm 100 is attached to a portable stand 105 including a horizontal base 110 shown supported on the ground. However, the base 110 may be attached to a trailer, truck, dolly, or other mobility apparatus, or may be fitted with wheels or treads to allow for self-contained mobility, or may be permanently or semi-permanently installed in a factory, process plant, shipyard, or other location as well. Vertical uprights 115*a*, 115*b* are attached at one end to base 110 and to a housing 120. An overhead beam 125 is mounted at point 124 along its length for controlled rotational motion in the horizontal plane. At one end of beam 125 are counter balance weights 130, 131. The downward extending control arm 100 is pivotally mounted at the opposite end of beam 125.

Motion forward and backward of control arm 100 is produced by pneumatic actuator 175 attached at one end to beam 125 and at the other end to the arm 100. Within the actuator 175 is a controllable piston (not shown) attached to piston rod 176. As shown, the end of rod 176 is pivotally attached to control arm 100 at a point below the piston pivot axis of control arm 100. As piston rod 176 is caused to translate by the controlled piston within actuator 175, the control arm 100 is caused to move forward and backward and thus change the fore and aft position of the gun 50, and hold the desired position.

A rotary motion producing pneumatic actuator is located within housing 120. This rotary actuator drives a vertical shaft connected to beam at point 124. As this rotary actuator is caused to rotate in a clockwise or counterclockwise direction, control arm 100 is caused to move in a circular path to the right or left of the operator 55.

An alternative embodiment of the water blast support apparatus is shown in FIGS. 2, 2A, 3 and 4. Control arm 200 is pivotally mounted at its upper end to pivot on axis 307 at the end of overhead beam 225. An assembly 226 including the barrel 51 of water blast gun 50, proportioning pneumatic valve control unit 227 and attached joystick 75 is attached at the lower end of control arm 200. The trigger operated valve 60 turns the volume of high pressure water on and off through barrel 51 from a water hose 45 (see FIG. 1) attached to the proximal end 52 of gun 50. The hose can be alternately attached to any number of locations to improve the handling of the unit.

Figure 4:
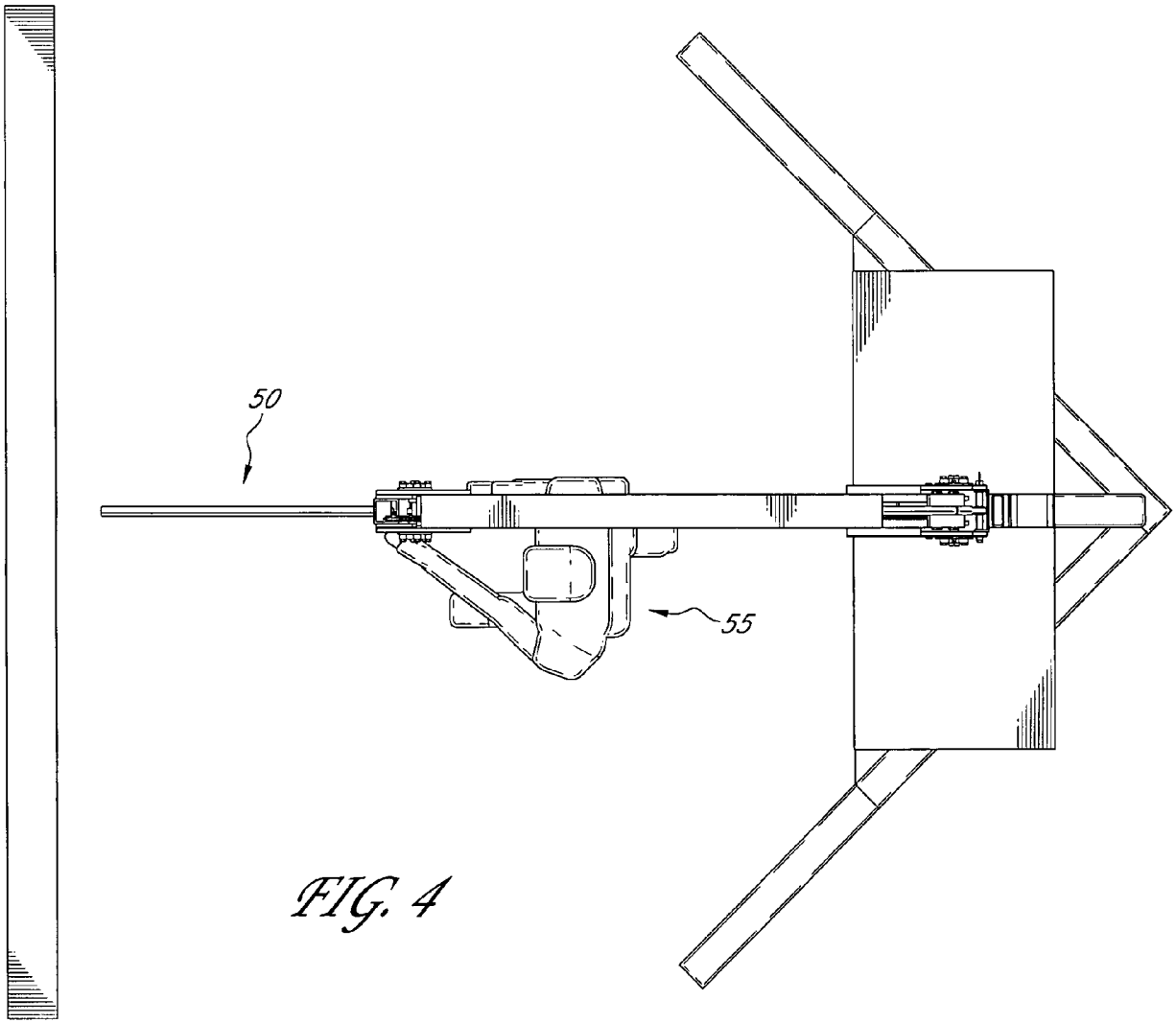
FIG. 4 is a top elevation view of the water blast gun apparatus of FIG. 2.

FIG. 4 is a top elevation view of the water blast gun being held by an operator. In this illustration the linear actuator is oriented in the same direction as the tip of the gun. In the neutral position the operator pushes the joystick forward (+x direction) to signal the linear actuator to apply force to in the +x direction. Pushing the joystick to the right (+y direction) signals the rotary actuator to apply force in the clockwise location. If the operator repositions himself by turning the gun ¼ turn clockwise then the signals to the actuators must be translated. Pushing the joystick forward (now in the +y direction) signals the rotary actuator to apply force in the clockwise direction. Pushing the joystick to the right (−x direction) signals the linear actuator to apply force in the −x direction. The operator can reposition himself from the neutral position by turning the gun clockwise by 30 degrees. To maintain the force balance along the direction of the gun the forward thrust of the joystick must be biased between both the linear and rotary actuator. The signal to the linear actuator is multiplied by the cosine of 30 degrees (0.866) and the signal to the rotary actuator is multiplied by the sine of 30 degrees (0.50). This maintains the balance between the two actuators as the operator repositions the gun relative to the support mechanism. The construction of the valve is such that the biasing control is calculated mechanically. The geometry follows a sinusoidal relationship hence the term "sinusoidal biasing". The unique design allows the operator to maintain the same motions for forward, back, left and right regardless of the direction of the waterblast gun assembly. The operator is free to rotate around the axis of the control arm 200.

The joystick 75 is connected to the water blast gun 50 by member 400 and 455 (see illustration 13). The coordinate system of the joystick 75 can be defined based on the axis of the gun barrel 51. Motion of the joystick forward along the axis of the barrel is defined as +x'. Motion perpendicular is +/−y'. As the water blast gun 50 rotates about the vertical member 200 the joystick 75 rotates along with the water blast gun 50. The coordinate system noted by x', y' is defined by the position and rotation of the water blast gun 50 and joystick 75 relative to the water blast support apparatus and is moveable. The only time the coordinate systems of the water blast gun 50 and the water blast support apparatus defined as X, Y, are aligned is shown by FIG. 4.

The water blast gun 50 is free to rotate about the axis of the vertical member 200. As it rotates the joystick 75 is oriented in the same direction as the axis of the gun barrel 51. In the neutral position shown in FIG. 4 the operator 55 pushes the joystick 75 forward in the +x' direction of the gun barrel 51 to actuate valve 430 and signal the linear motion actuator 275 to apply force in the +X direction of the water blast support apparatus. Pushing the joystick 75 to the right in the +y' direction actuates valve 420 and signals the rotary actuator assembly 120 to apply force in the clockwise direction.

If the operator 55 rotates the water blast gun 50 about the axis of the vertical member 200 one quarter turn clockwise (+90 degrees) the signals to the actuators must be translated. The operator 55 resists the force of the water blast gun 50 by pushing the joystick 75 forward in the +x' direction relative to the gun barrel 51. This motion now actuates valve 420 and signals the rotary actuator assembly 120 to apply force in the clockwise direction. Pushing the joystick to the right in the +y' direction relative to the gun barrel 51 actuates valve 431 and signals the linear motion actuator 275 to apply force in the −X direction relative to the water blast support apparatus.

In a third example the operator 55 can reposition the water blast gun 50 clockwise by 30 degrees about the axis of the vertical member 200 from the neutral position of FIG. 4. The operator 55 continues to resist the force of the water blast gun 50 by pressing forward on the joystick 75 in the +x' axis of the gun barrel 51. To maintain the force balance along the axis of the gun barrel 51 the signals must be biased between both the linear motion actuator 275 and rotary actuator assembly 120.

Based on this example, the displacement of the joystick is multiplied by the cosine of 30 degrees (0.866) to determine the stroke of valve 430 and multiplied by the sine of 30 degrees (0.50) to determine the stroke of valve 420. This maintains the balance between the two actuators 275 and 120 as the operator 55 repositions the water blast gun 50 relative to the support mechanism. The construction of the valve assembly 226 is such that the biasing control is calculated mechanically. The geometry follows a sinusoidal relationship hence the term "sinusoidal biasing". This unique design allows the operator 55 to maintain the same motions for forward, back, left and right regardless of the direction of the water blast gun assembly 50.

Figure 2:
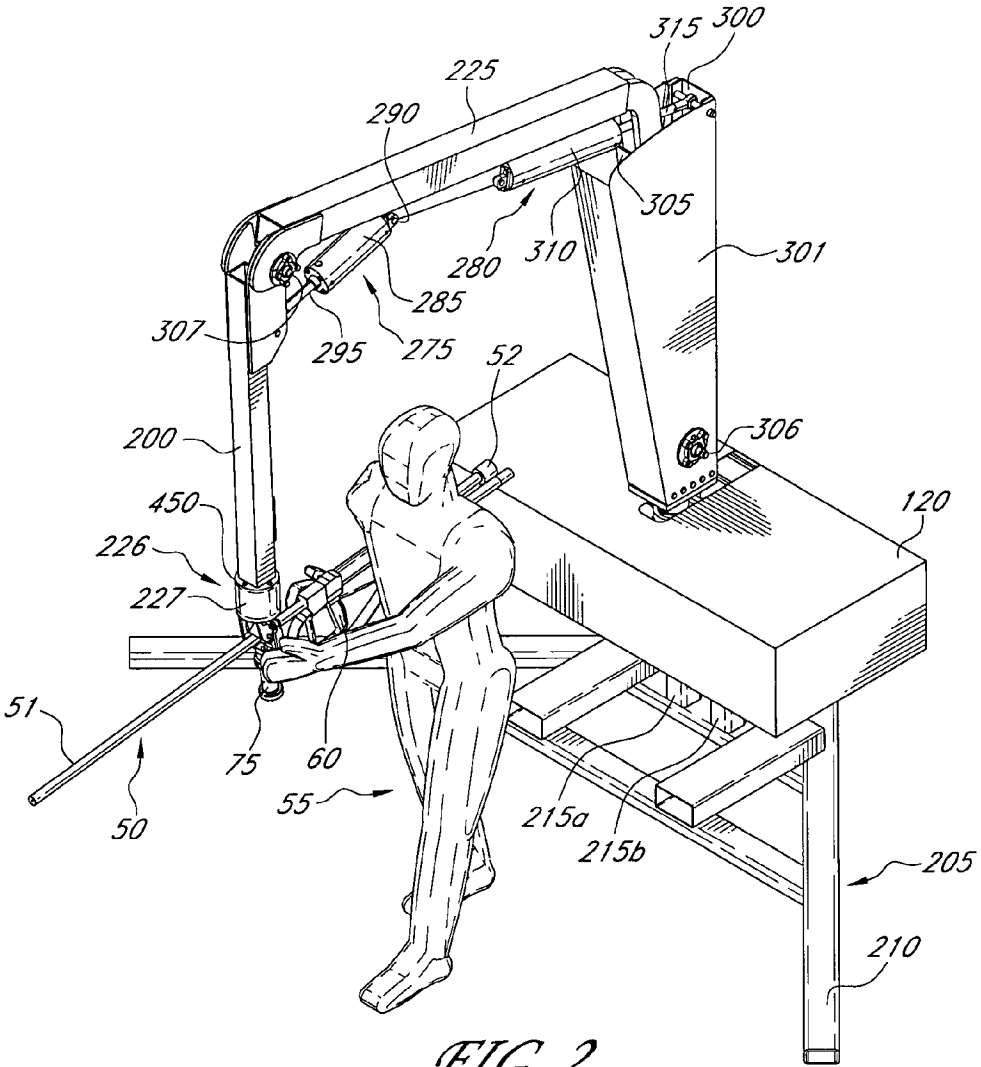
FIG. 2 is a perspective view of another embodiment of the water blast gun apparatus.
Figure 2A:
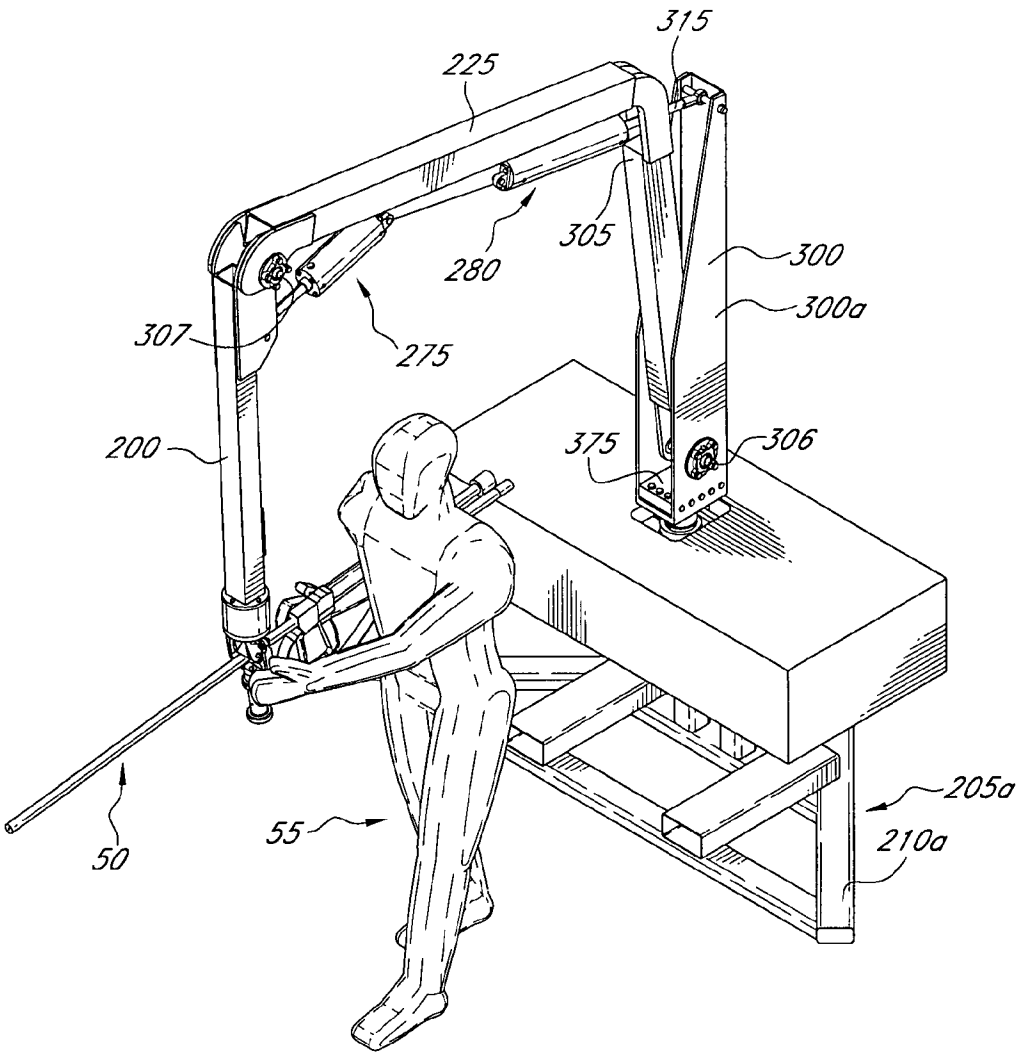
FIG. 2A is a perspective view of an alternate configuration of the water blast gun apparatus.
Figure 3:
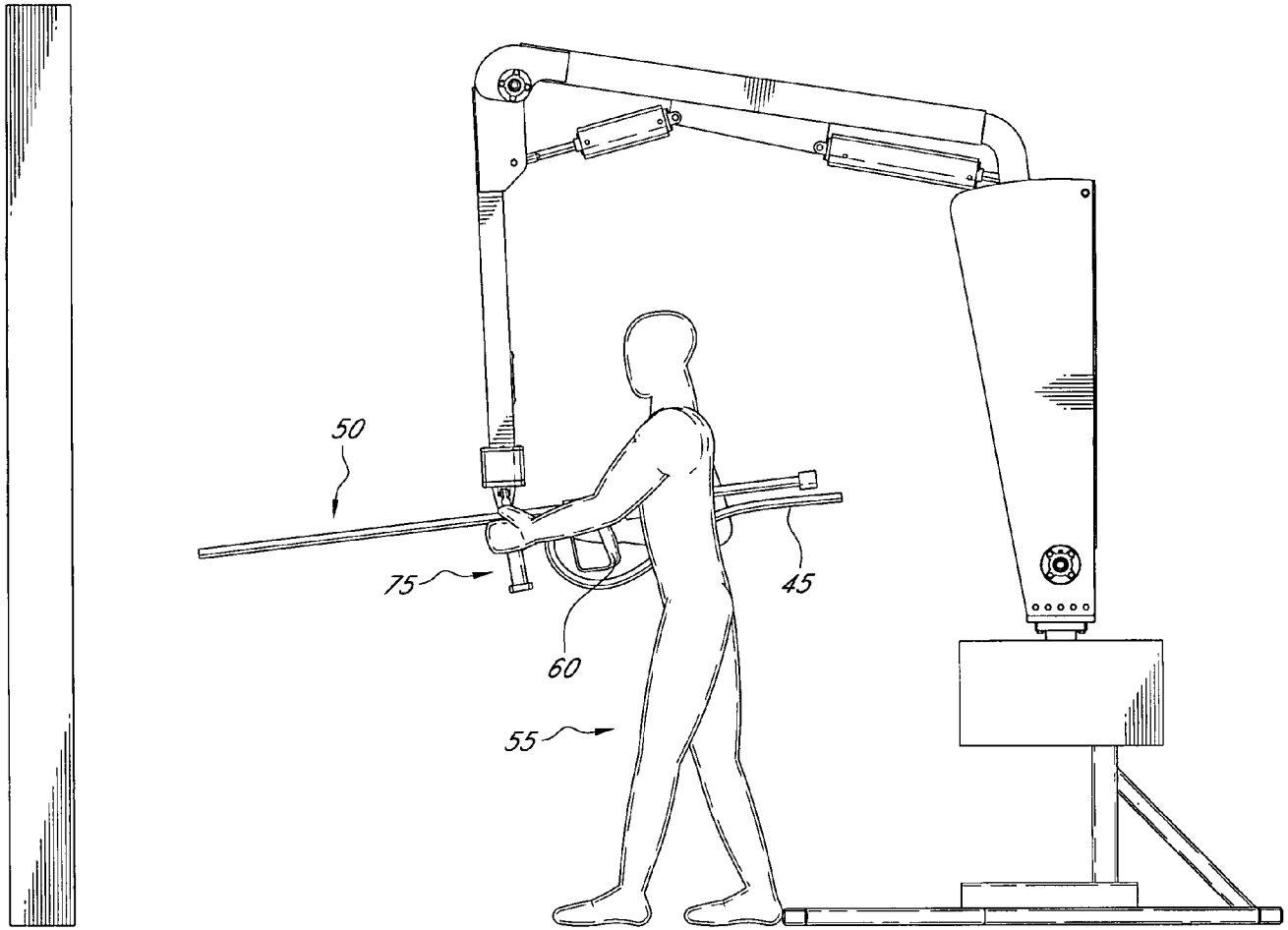
FIG. 3 is a side elevation view of the water blast gun apparatus of FIG. 2.

Portable stand 205 includes a base structure 210. A modified base 210*a* is shown in FIG. 2A. Uprights 215*a*, 215*b* are attached at one end to base 210 and at their other end to the bearing support plate 216 (shown in FIG. 8).

A generally U-shaped upright beam assembly 300 (best shown in FIG. 2A) is rotatably mounted to a controllable rotary actuator located within housing 120. Overhead beam 225 is rigidly attached to one end of a pivot beam 305. The opposite end of beam 305 is pivotally mounted to upright beam 300 around an axis defined by axle 306. A shroud 301 shown in FIG. 2 may substantially cover enclose pivot beam 305.

Controlled movement of control arm 200 left, right, up and down (and corresponding controlled movement of the water blaster gun 50) is provided by a pneumatic actuator system including linear motion producing actuators 275 and 280. One end of actuator 275 is pivotally attached to beam 225 to pivot on axis 290. Extending from cylinder 275 is a controlled piston rod 295 whose end is pivotally attached to control arm 200. Thus, controlled linear movement of rod 295 results in a controlled pivotal movement and/or maintenance of a static position of control arm 200 around pivot axis 307.

The cylinder 310 of the second pneumatic actuator 280 is pivotally mounted to overhead beam 225. The end of linear drive rod 315 of actuator 310 is attached to upright 300. Accordingly, controlled linear motion of rod 315 results in motion of the attached beams 200, 225 and 305 around axis 306. Actuator 280 thus provides controlled vertical up and down movement of the gun 50.

Figure 5:
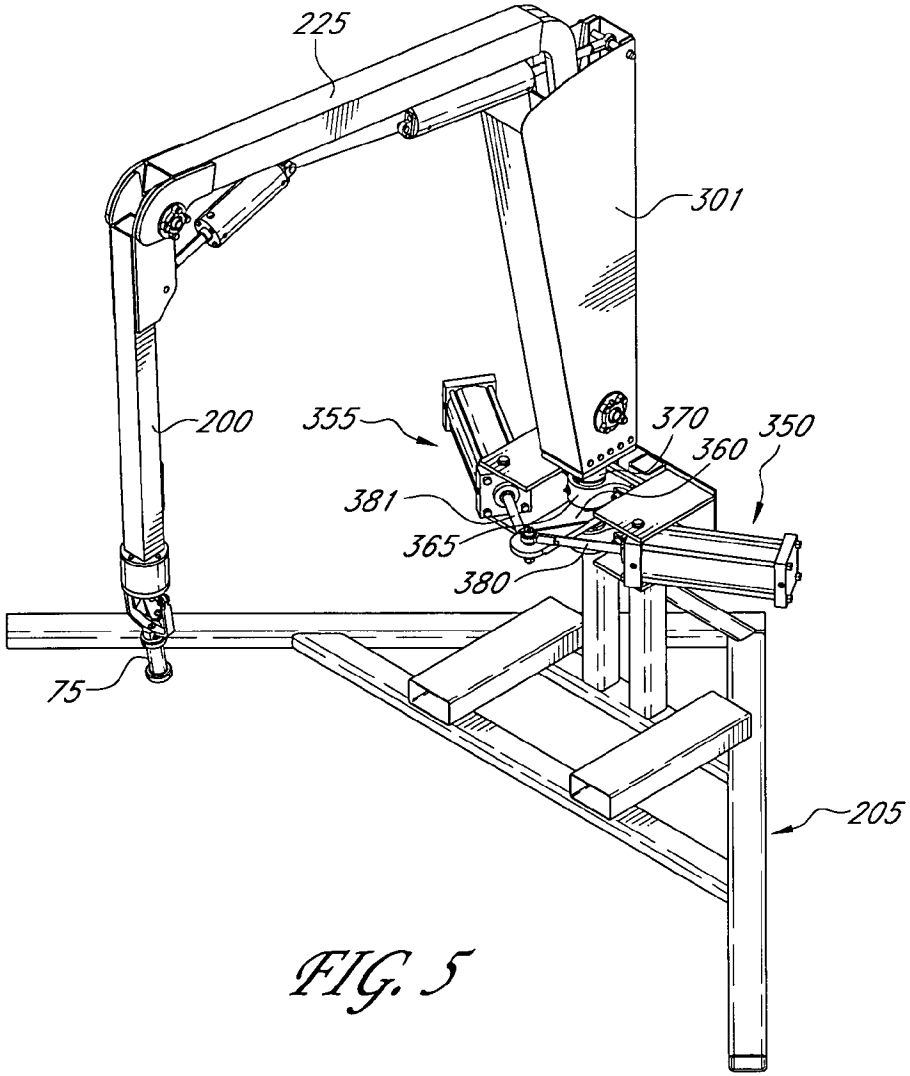
FIG. 5 is a perspective view of the actuator used to control rotation of the water blast gun in the horizontal plane.
Figure 6:
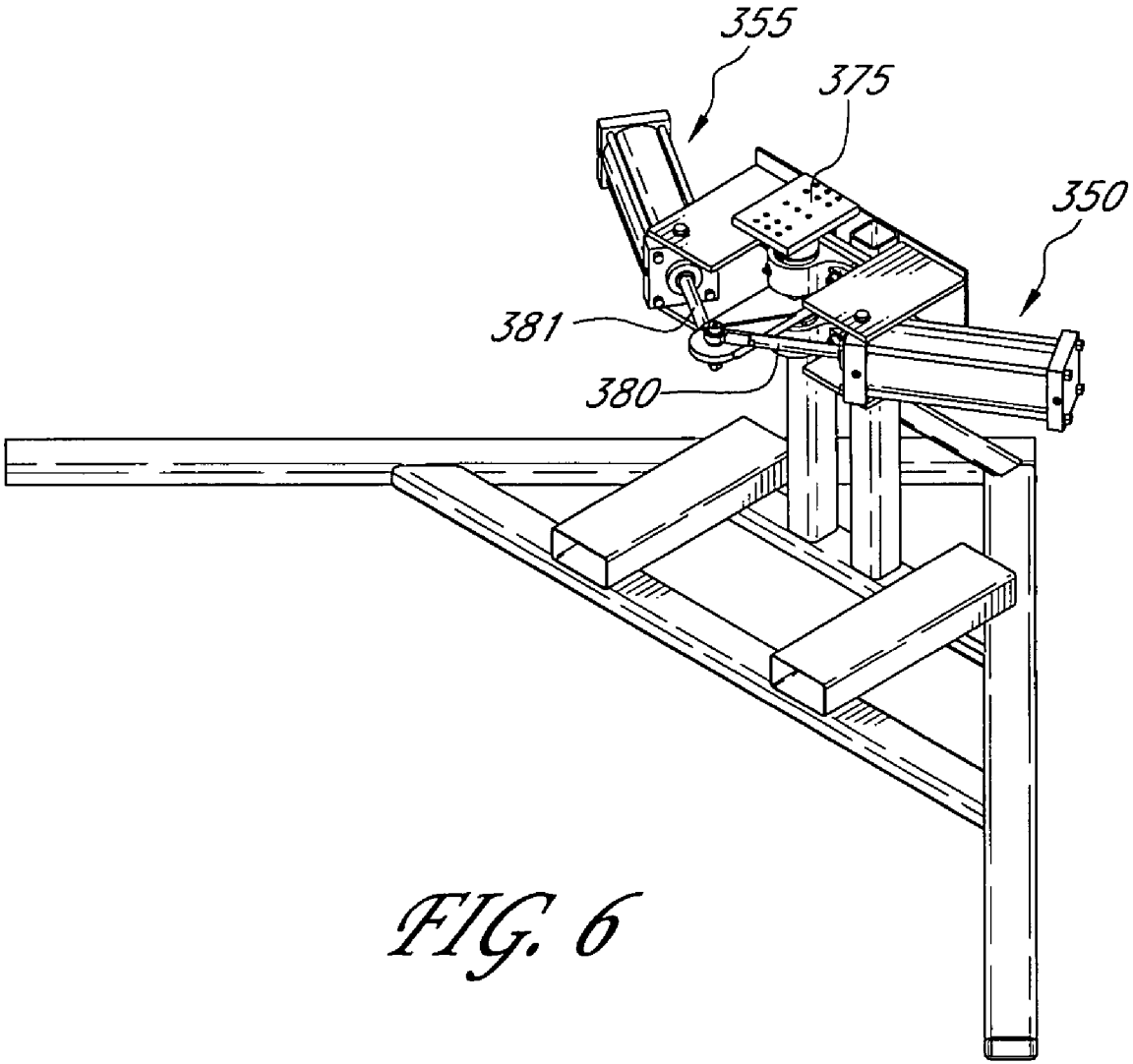
FIG. 6 is another perspective view of the actuator apparatus of FIG. 5 with the upright, overhead and control beams removed.

Controlled motion of gun 50 in the left and right directions is achieved by controlled rotation of beam 300 by a pair of pneumatic cylinders and bell crank located within housing 120. The apparatus for controlled rotary motion of control arm 200 is shown in FIGS. 5-12. Referring now to FIGS. 5 and 6, the housing 120 has been removed to expose the pneumatic linear actuators 350 and 355. These actuators are located on opposite sides of bell crank 360. One end of bell crank 360 is attached to shaft 370 rotatably mounted in bearing 365 with respect to base 205. The opposite end of shaft 370 is attached to bottom plate 375 of upright beam 300 (see FIGS. 2A and 6). The ends of respective piston rods 380, 381 of the actuators 350, 351 are pivotally connected to the other end of bell crank 360 to translate the back and forth controlled linear motion of the piston rods 380, 381 to controlled rotary motion of shaft 365, and its attached upright beam 300. Rotary motion of beam 300 results in translation of control arm 200 and gun 50 in left and right directions. Thus, translation of piston rod 380 out of cylinder 350 with corresponding translation of piston rod 381 into cylinder 355 results in clockwise rotation of upright beam 300 and movement of control arm 200 and gun 50 in the right-hand direction in the FIGURES.

Figure 7:
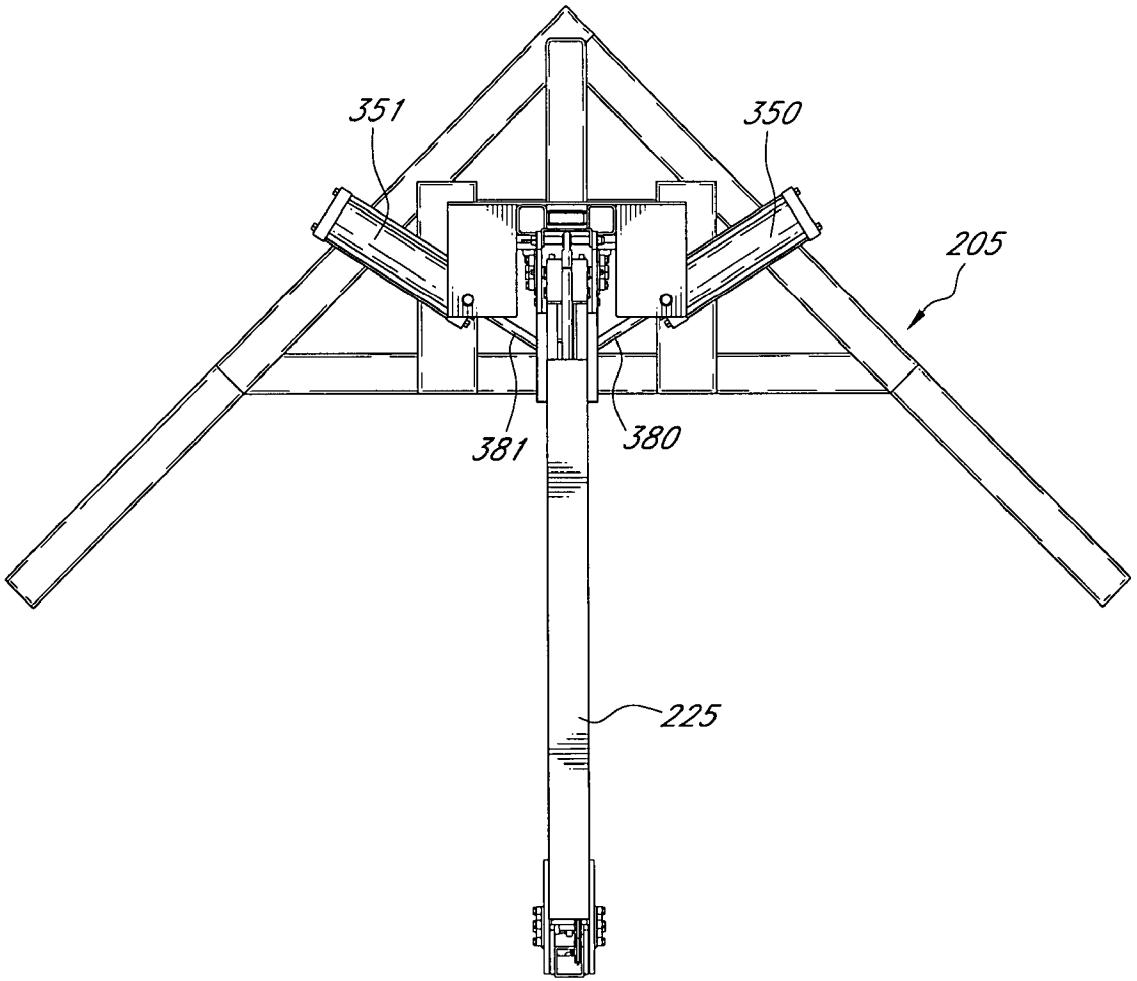
FIG. 7 is a top elevation view of FIG. 5 illustrating the position of the actuator with the control arm at its midpoint of movement in the horizontal plane.
Figure 8:
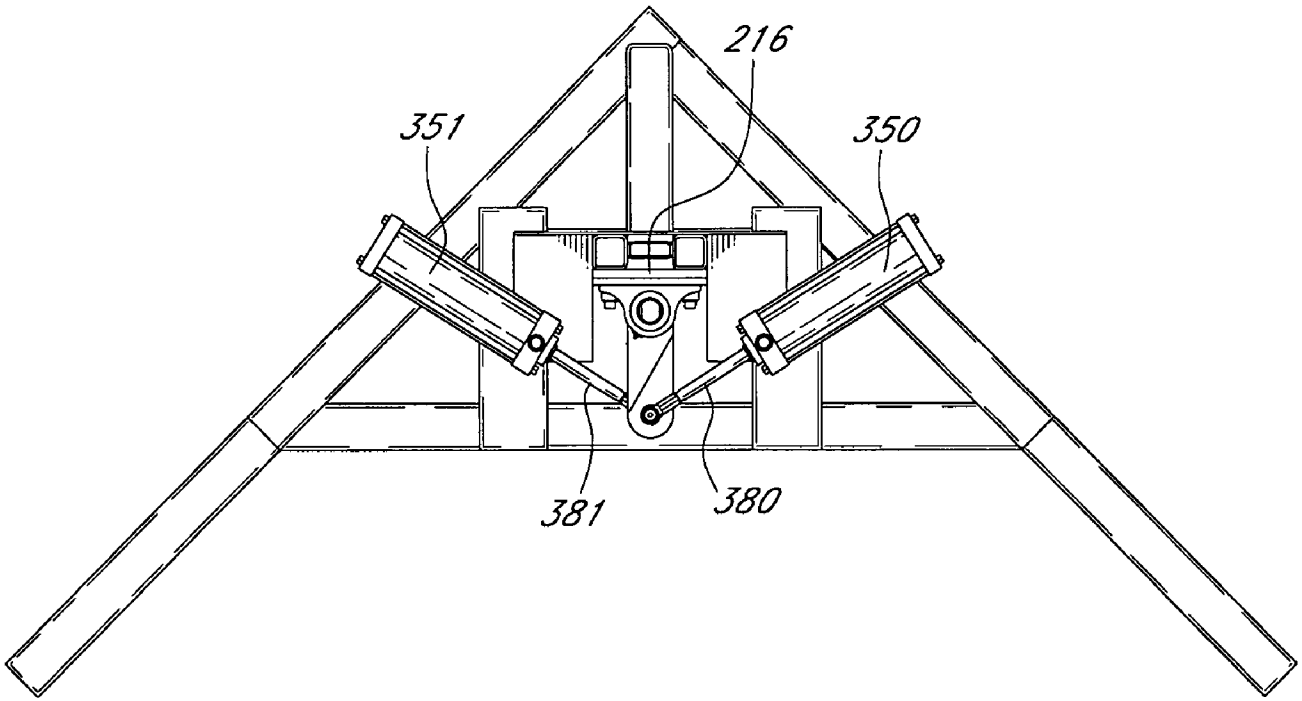
FIG. 8 is a top elevation view of FIG. 7 with the beams removed.

FIGS. 7-12 illustrate the movement of overhead beam 225 as it is translated to its limits in a clockwise direction and in a counterclockwise direction. As shown in FIGS. 7 and 8, piston rods 380 and 381 are extended equal distances from their respective actuators 350, 351 and the overhead beam 225 is centered with respect to the base 205.

Figure 9:
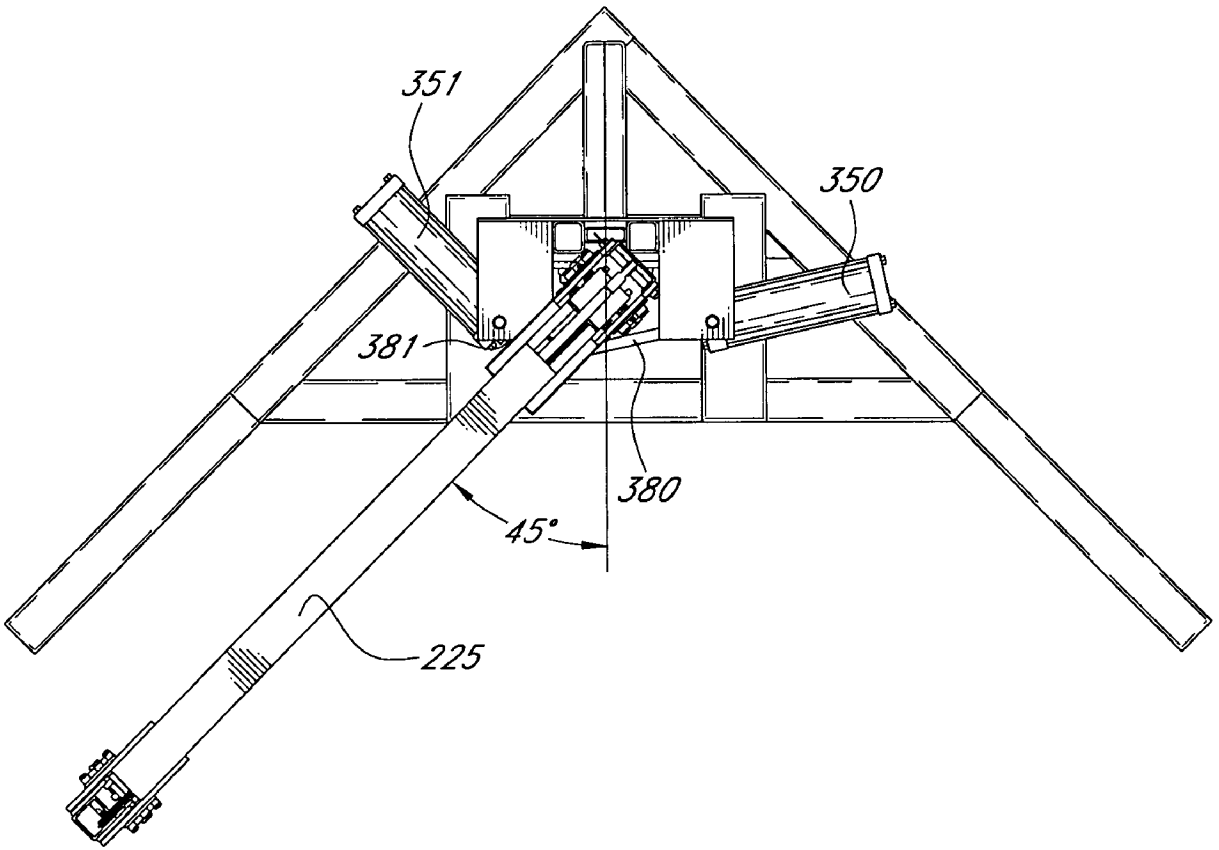
FIG. 9 is a top elevation view of FIG. 5 illustrating the position of the actuators when the control arm is at its extreme clockwise position.
Figure 10:
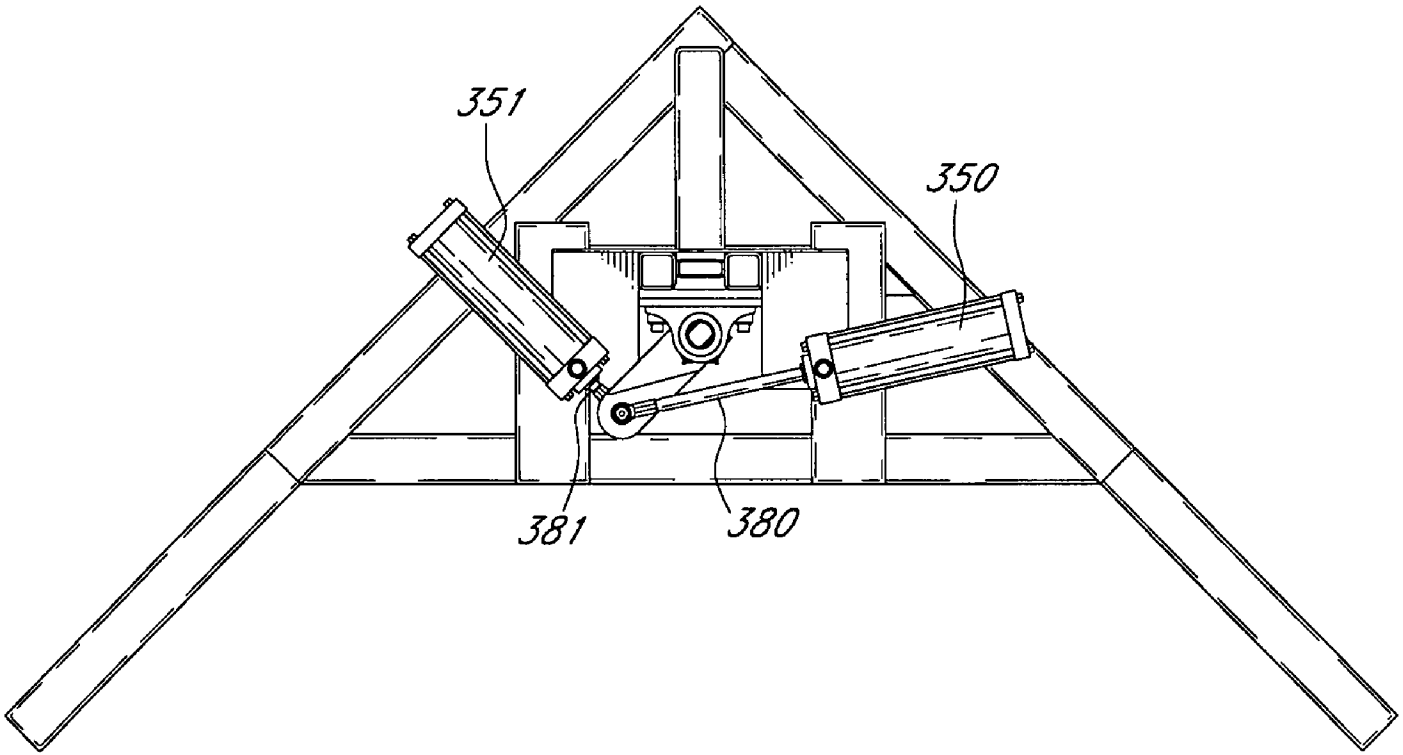
FIG. 10 is a top elevation view of FIG. 9 with the beams removed.

In FIGS. 9 and 10, the piston end 380 is extended out from actuating to its maximum extension and piston rod 381 is withdrawn into its actuator 351 to its minimum extension to rotate beam 225 clockwise 45° from its center position shown in FIGS. 7 and 8.

Figure 11:
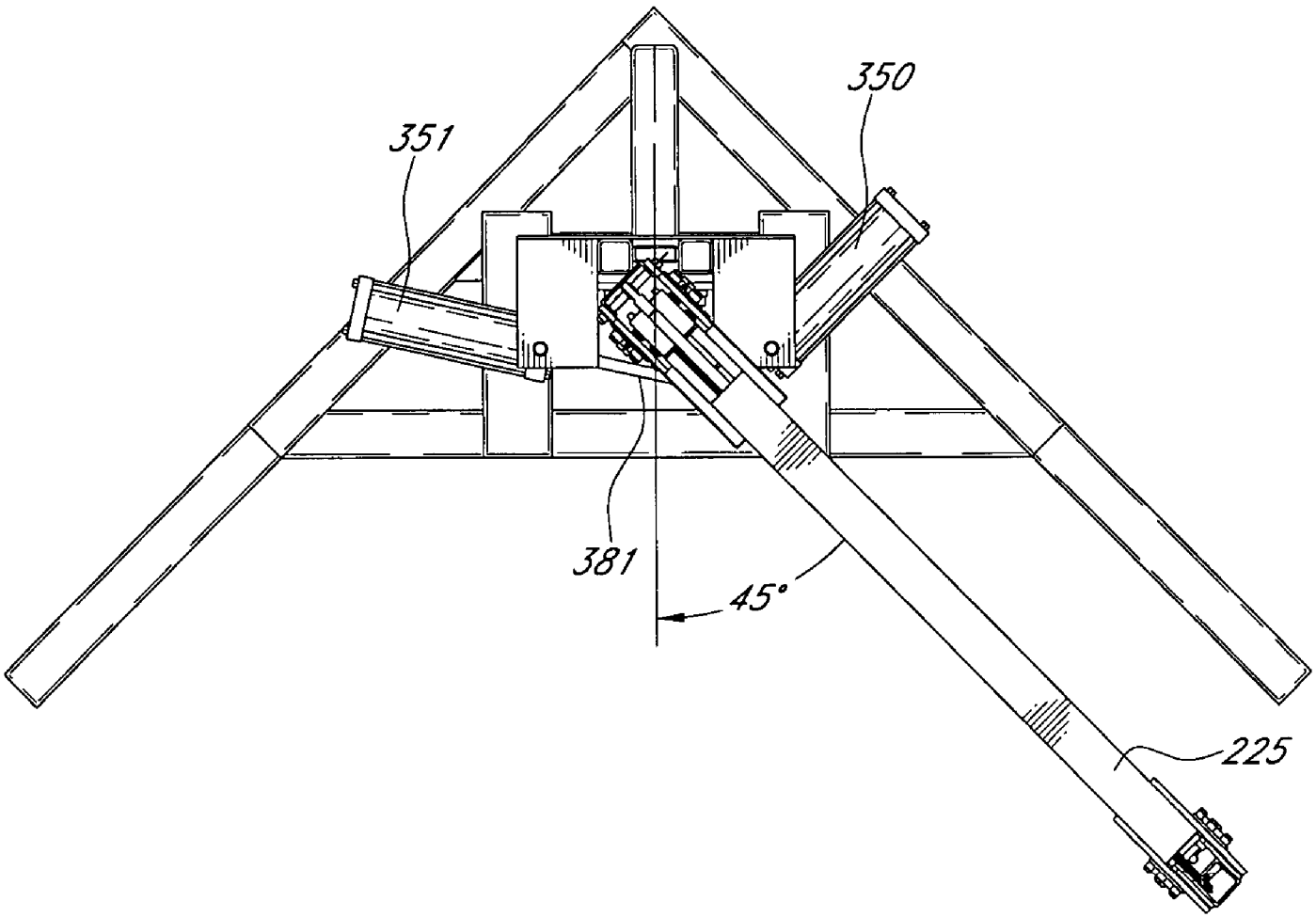
FIG. 11 is a top elevation view of FIG. 5 illustrating the position of the actuators when the control arm is at its extreme counter-clockwise position.
Figure 12:
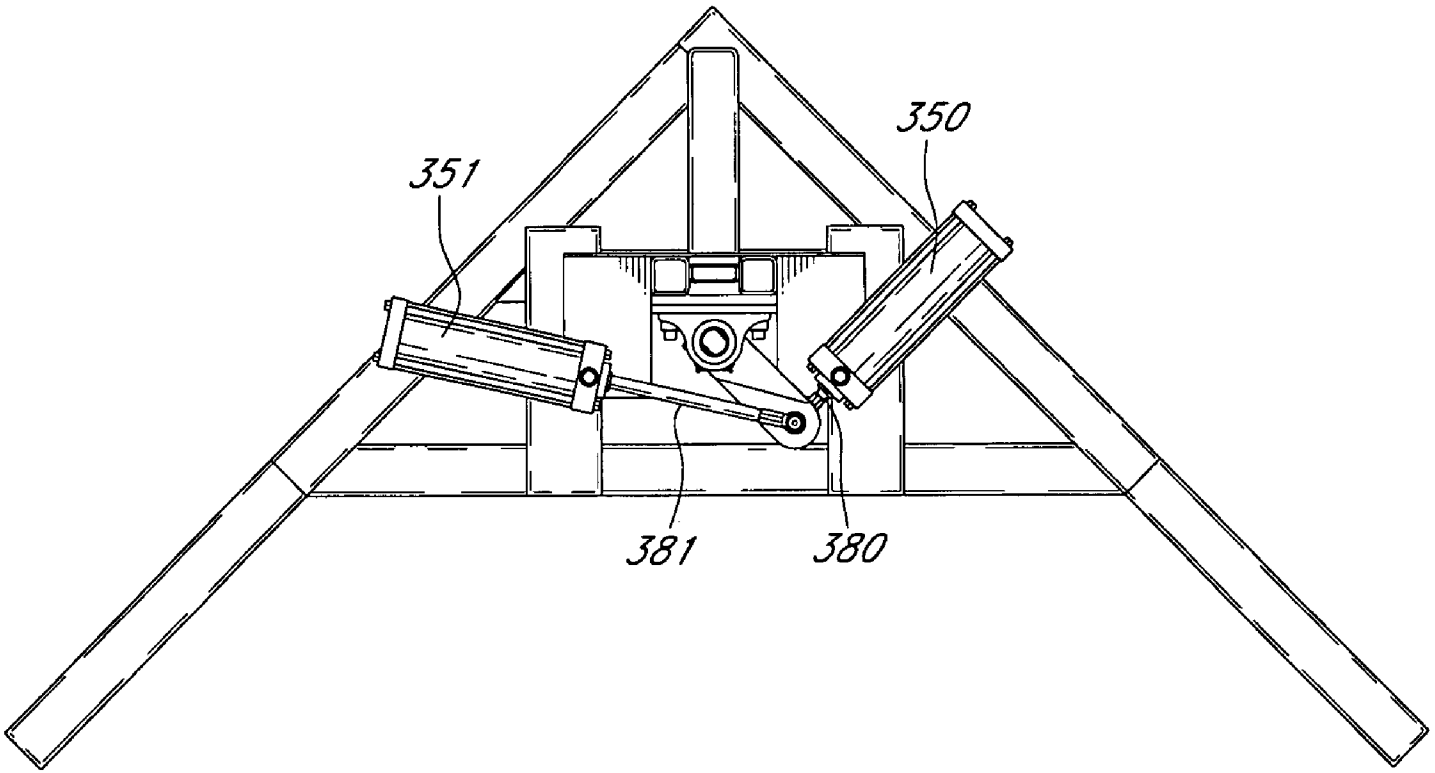
FIG. 12 is a top elevation view of FIG. 11 with the beams removed.

In FIGS. 11 and 12, the piston rod 380 is withdrawn into its actuator 350 to its minimum extension and piston rod 381 is extended out from actuator 351 to its maximum extension to rotate beam 225 counterclockwise 45° from the center position shown in FIGS. 7 and 8.

The apparatus and operation of one embodiment of control unit 227 is illustrated in FIGS. 13-17. Joystick 75 is attached to the bottom member 401 of a rigid generally rectangular frame 400. The proximal end 405 of a pneumatic slide actuator member 406 (shown in FIG. 15) is rigidly attached to the top member 402 of frame 400. Actuator member 406 includes a generally spherical surface 410 supported by a spherical bearing within the unit 227 such that movement of the joystick 75 will produce a similar movement of the actuator member 406. The embodiment shown of control unit 27 is a pneumatic sinusoidal biasing system wherein movement of actuator member 406 is coupled to pneumatic proportional valves 420, 421 and 430, 431 located within unit 227 (best shown in FIG. 13 and in FIGS. 16A and 16B (sections E-E and F-F of FIG. 16). This operation is provided in the embodiment shown by the distal end 425 of slide actuator member 406. End 425 is formed to function as a control rod that engages orthogonally positioned slide actuators 426 and 427. See, e.g., slide actuator 426 in FIG. 13 and in FIG. 16A and slide actuator 427 in FIG. 13.

Figure 13:
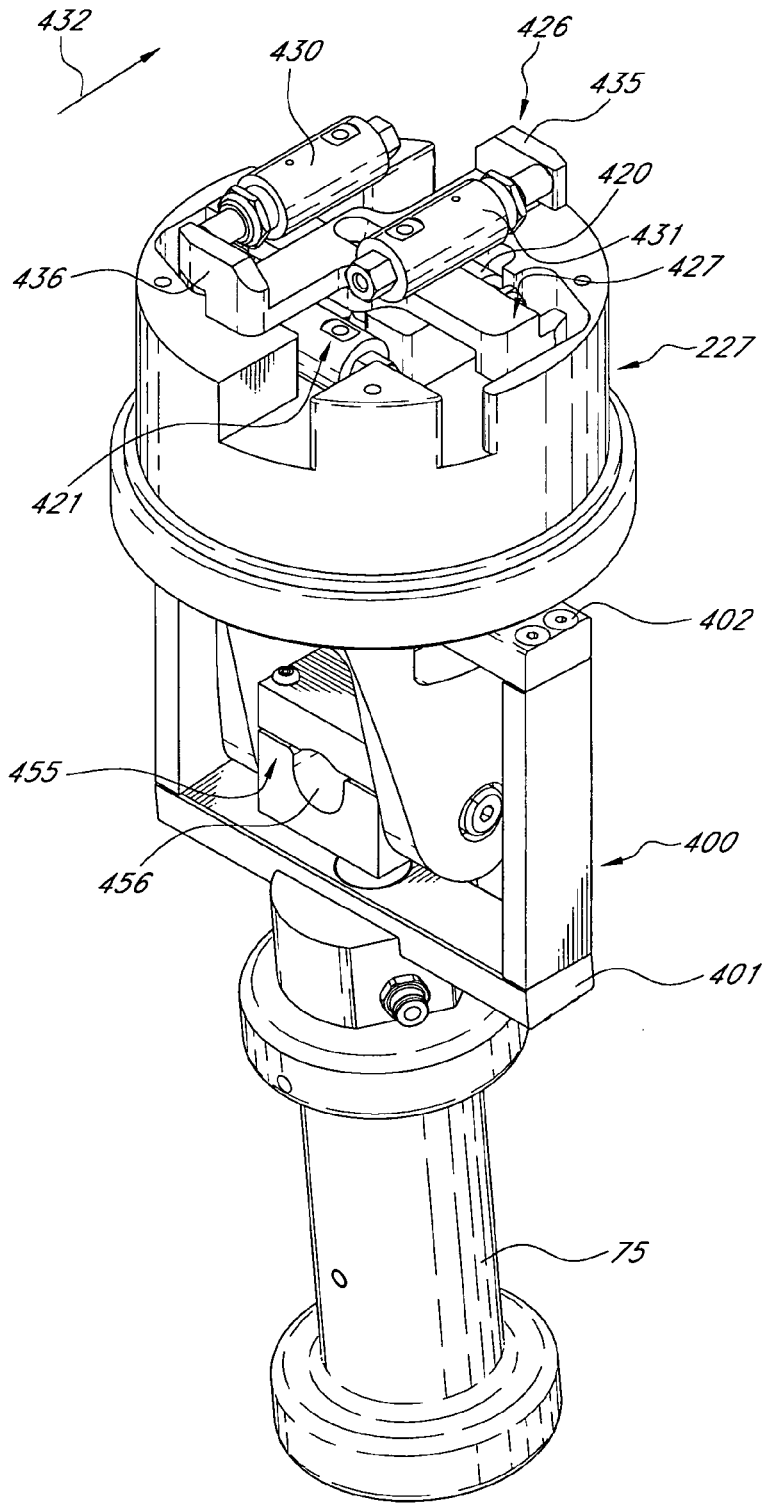
FIG. 13 is a perspective view of the joystick controlled pneumatic biasing control unit with the top cover removed to show the orthogonally positioned pneumatic proportioning valves.

Slide actuator 426 of unit 227 includes end members 435, 436 adapted to respectively engage valves 431, 430. Referring to FIG. 13, as control rod 425 moves slide actuator 426 in the direction of arrow 432, the force applied to valve 430 by member 436 is increased and the force applied to valve 431 by member 435 remains zero. This change in the output of air pressure through these orthogonally opposed valves 430, 431 is used as the control signal, i.e. controlled air pressure flows out of the slide valves of unit 227 actuate movement and/or maintenance of a static position of the pneumatic actuators 275, 280, 350, 351 to control and position arm 200 and gun 50 in the direction of arrow 432. As the operator changes the direction of joystick 75, the pneumatic control unit 227 changes the control signal pressures that are sent to actuators.

Figure 14:
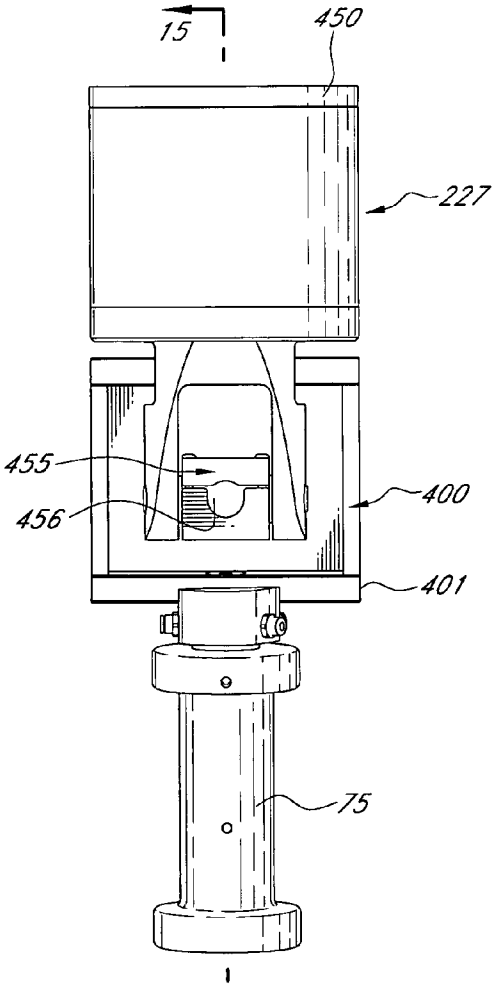
FIG. 14 is a side elevation view of FIG. 13 with the control unit cover replaced.

As shown in FIGS. 13 and 14, a gun support bracket 455 is attached to the bottom of the unit 227. The barrel 51 of gun 50 is rigidly mounted within cylindrical opening 456 of bracket 455. As shown, for example, in FIG. 2, the top cover plate 450 of pneumatic biasing control unit 227 is rigidly attached to the bottom end of control arm 200.

The pneumatic proportioning slide valves 420, 421 and 430, 431 thus control the air pressure to the respective pneumatic actuators 275, 280, 350 and 355 described above such that operator movement of the joystick 75 results in controlled movement of the gun 50 to the desired position. When the joystick is returned to a neutral position, the unit 227 maintains the static position of control arm 200.

A series of air flow hoses and other pneumatic control devices couple the pneumatic sinusoidal bias control unit 227 to the actuators 275, 280, 350, 355 which move the control arm 200. Typically, an input hose delivers air at 100 psi to valve 227. Four hoses, two of which are connected to valves 420, 421 and the other two connected to valves 430, 431, deliver the controlled air provided by the orthogonal slide valves to the pneumatic actuators 275, 280, 350 and 355.

Figure 15:
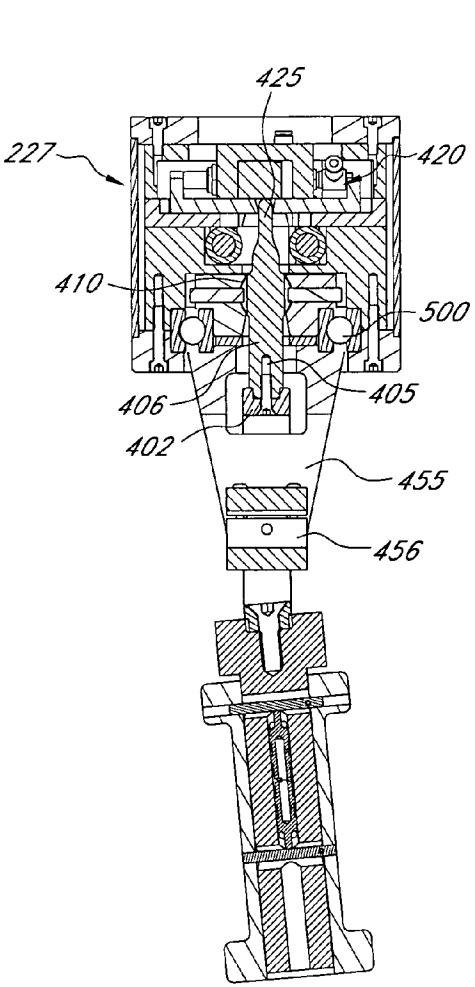
FIG. 15 is a sectional view of FIG. 14 taken along line 15-15.
Figure 16:
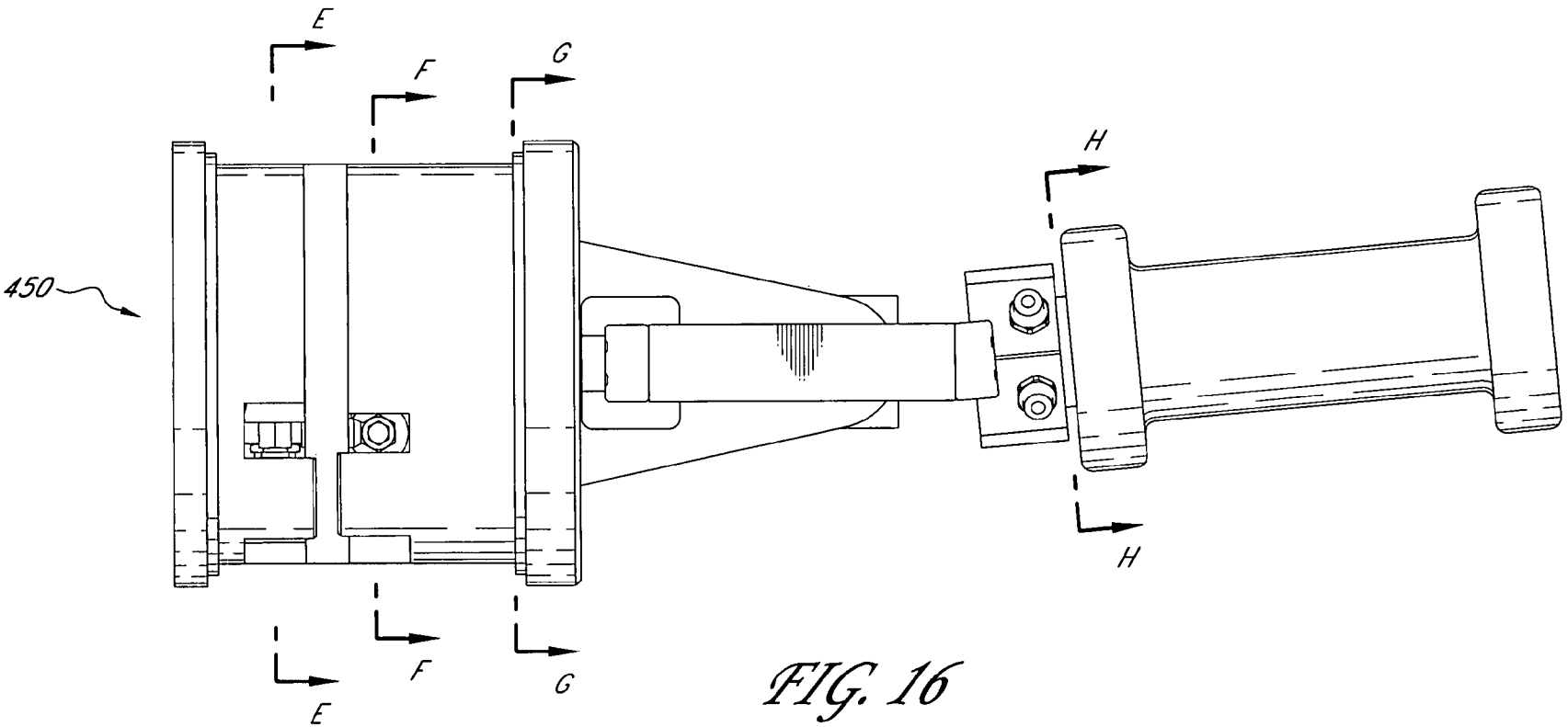
FIG. 16 is another side elevation view of the joystick controlled pneumatic biasing control unit.
Figure 16A:
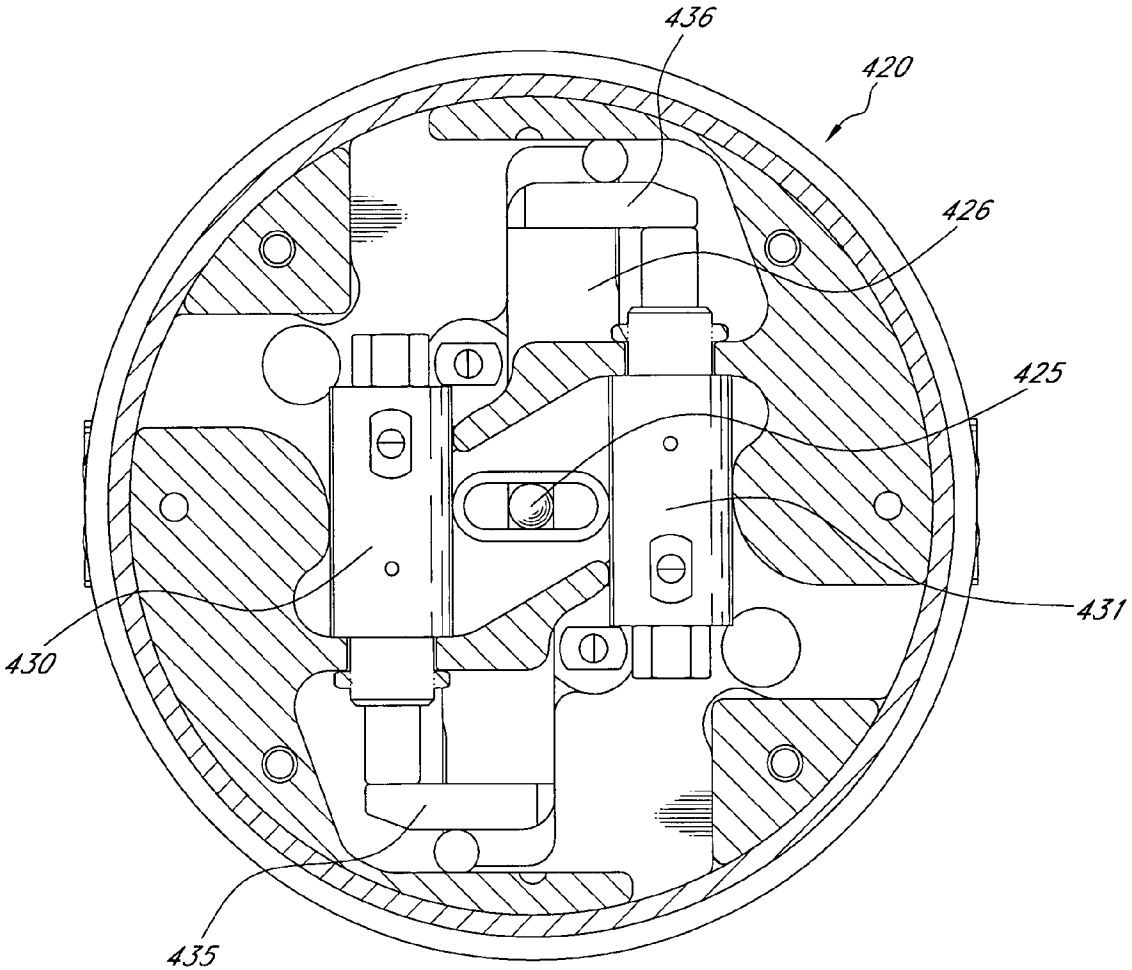
FIG. 16A is the cross-sectional view E-E of FIG. 16.
Figure 16B:
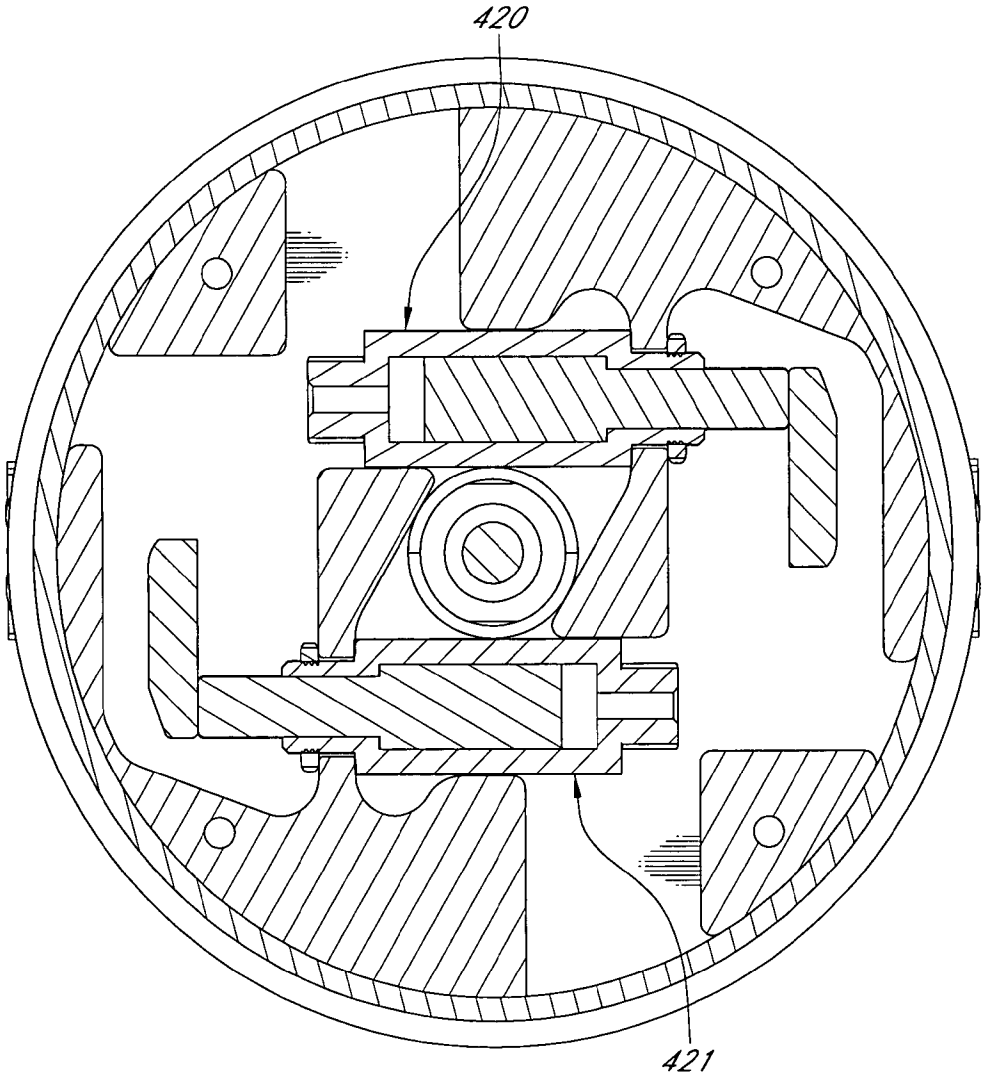
FIG. 16B is the cross-sectional view F-F of FIG. 16.
Figure 16D:
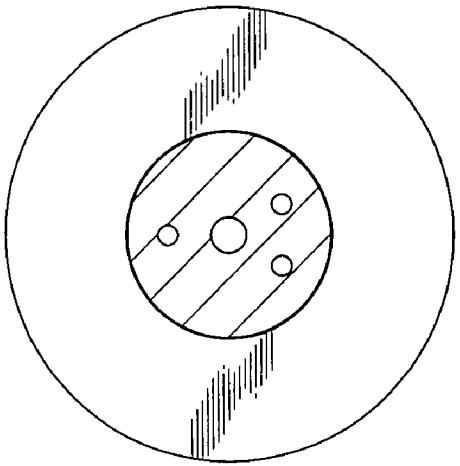
FIG. 16D is the cross-sectional view H-H of FIG. 16.
Figure 16C:
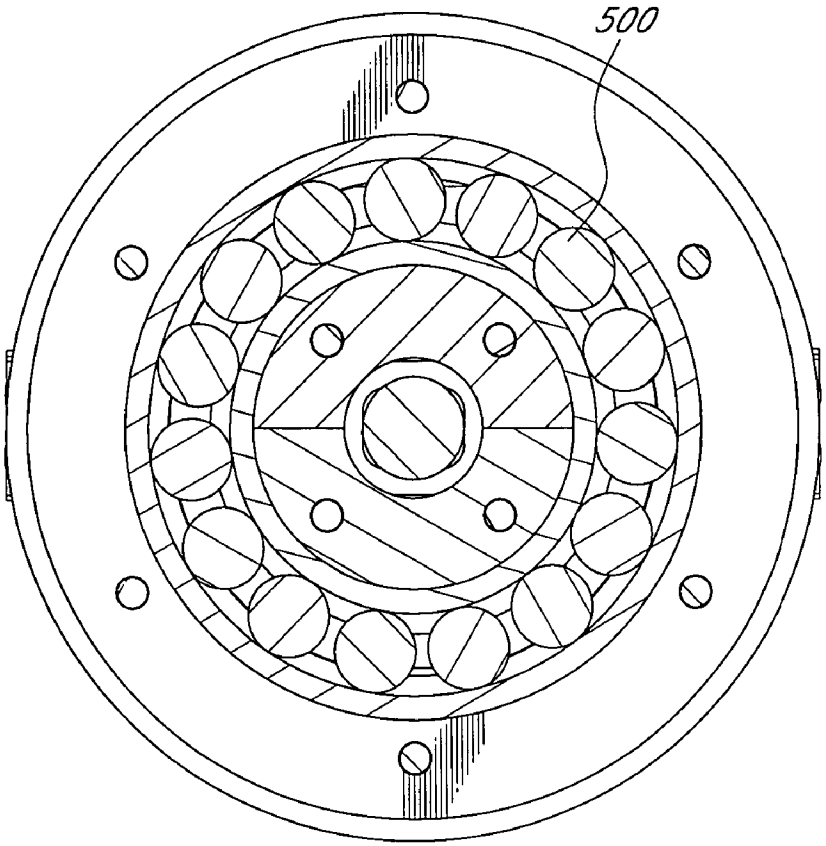
FIG. 16C is the cross-sectional view G-G of FIG. 16.
Figure 17:
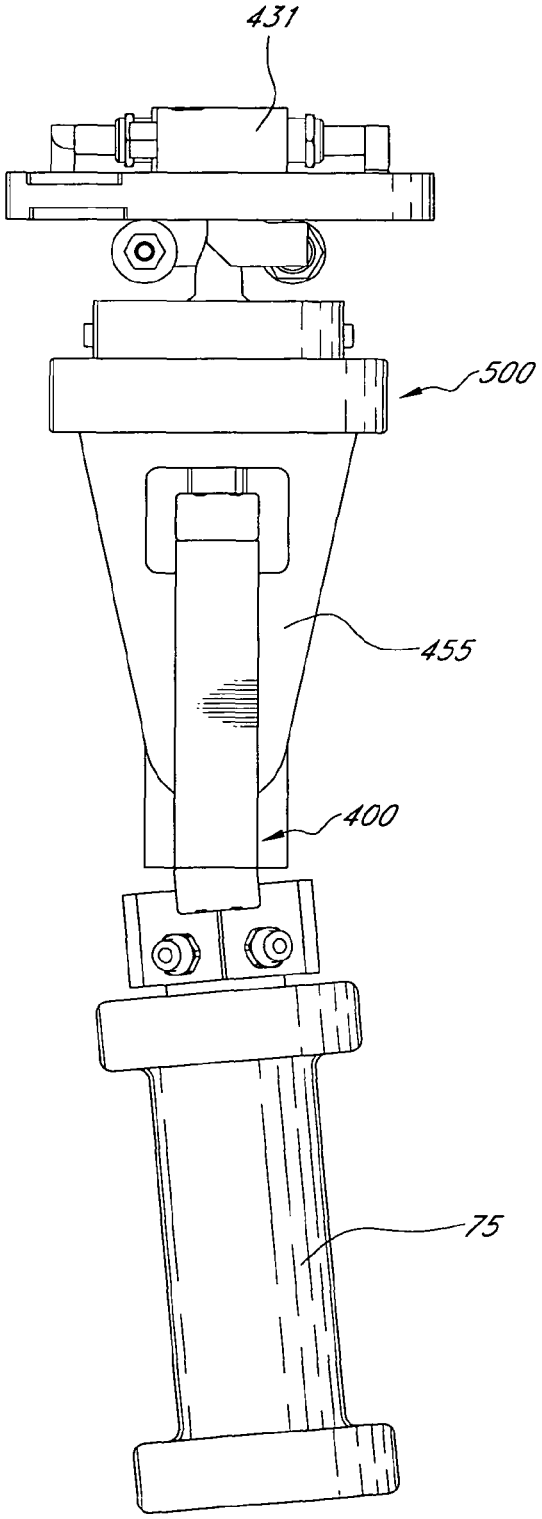
FIG. 17 is a simplified drawing of a portion of the joystick controlled pneumatic biasing control unit illustrating the apparatus and function of the rotary bearing.

A feature of the pneumatic sinusoidal biasing control unit 227 is that the operator is free to rotate the gun on its mount; up, down, left, or right, and move the gun manipulator arm in any direction while the pneumatic sinusoidal biasing system is controlling arm 200. FIG. 15, FIG. 16C and FIG. 17 illustrate the manner in which the joystick and its attached gun are free to rotate with respect to the arm 200. The pneumatic sinusoidal biasing control unit 227 includes a ball bearing 500. The outer race of bearing 500 is attached to housing of the pneumatic slide valves 420, 421, 430 AND 431. Accordingly, these valves are fixed relative to control arm 200. Joystick 75, gun support bracket 455 and actuator member 406 are attached to the inner race of bearing 500 and are thus free to rotate relative to control arm 200. Thus, at any position of the control arm, the operator is free to swivel the gun barrel right or left in ball bearing 500, and up or down in the gun mount yoke while directing and controlling its counter thrust and position by pointing the joystick in the desired direction. The operator does not need to constantly readjust his x-y orientation, but the pneumatic sinusoidal biasing control valve does this for him.

The gun apparatus and methods described above counter operator fatigue while giving the operator substantial freedom in controlling the gun. Thus, the operator can "drive" the gun 50 left, right, up or down, and/or maintain a static position, without losing the ability to reduce the net thrust the operator feels from the water blast gun. Moreover, at any angle, the biasing mechanism gives the operator an intuitive control interface.

The above presents a description of the best mode contemplated for carrying out the water blast gun apparatus and methods in such full, clear, concise and exact terms as to enable any person skilled in the art to which it pertains to make and use this apparatus and practice these methods. While the pneumatic biasing control unit described above advantageously provides a sinusoidal bias control signals, other pneumatic biasing control units including linear bias units could be utilized in embodiments of the inventions. Also, while the embodiments of control system described above have involved a pneumatic control system, it will, however, be apparent that other embodiments are possible that utilize electrical or hydraulic or in combination with pneumatic components. Consequently, this water blast gun support apparatus and methods are not limited to the particular embodiments disclosed. On the contrary, these water blast gun support apparatus and methods cover all modifications and alternative constructions coming within the spirit and scope of this invention.

What is claimed is:

1. A water blast gun support for automatically reducing the thrust of the water blast apparatus felt by the operator by converting signals from an operator to a pair of actuators fixed in position and attached to the support structure, said water blast gun support comprising:

a stand;

a substantially vertical control arm;

a joystick attached at the bottom end of said substantially vertical control arm;

a horizontal overhead beam, rotatably mounted to said stand;

a first motion producing actuator coupled between said control arm and said horizontal overhead beam to move said control arm forward and backward;

a second motion producing actuator coupled between said stand and said horizontal overhead beam to rotate said beam in both clockwise and counterclockwise directions; and a control unit having an actuator input member, said member being rigidly attached at the bottom end of said vertical control arm and operatively coupled to said first motion producing actuator and said second motion producing, said control unit comprising:

a substantially spherical bearing which mounts the actuator input member to said control unit to provide a requisite freedom of movement of said actuator member relative to said control unit;

wherein said joystick is rigidly attached to said actuator input member so that movement of said joystick results in movement of said first and second motion producing actuators to controllably direct said water blast gun both to the right and left and up and down directions based upon said operator signals.

2. The water blast gun support apparatus of claim 1 wherein said first and second motion producing actuators are pneumatic actuators; and wherein said actuator member is coupled to pneumatic valves of said control unit which transmit controlled air flows to said pneumatic actuators to provide controlled movement of said overhead beam and said control arm.

3. The water blast gun support apparatus of claim 1 comprising a substantially vertical upright beam assembly attached to said overhead beam and rotatably mounted to said stand.

4. The water blast gun support apparatus of claim 1 including a vertical upright beam attached to said horizontal overhead beam, a bell crank attached to said vertical upright beam, and a pair of linear actuators attached to said bell crank to operatively rotate said bell crank by moving the rod of one of said actuators in one direction and moving the rod of the other of said actuators in the opposite direction.

5. The water blast gun support apparatus of claim 1 wherein said joystick is free to rotate relative to the control arm so that the operator is free to swivel said water gun relative to said control arm.

6. The water blast gun support apparatus of claim 5 wherein said rotational freedom is provided by the outer race of a bearing attached to the housing of the control unit and said actuator member attached to the inner race of said bearing.

7. The water blast gun support apparatus of claim 1 having a water valve mounted proximal said joystick so that the operator can selectively control an amount of water blasting out of said gun while directing the up and down and right and left position of said water gun.

8. A water blast gun support apparatus comprising:

a stand;

a beam rotatably mounted to the stand;

a control arm pivotally mounted to the beam;

at least one counter balance weight connected to an end of the beam opposite the end where said control arm is mounted;

an actuator system comprising:

a first actuator member that is of a rotary type for controlling rotation of the beam;

a second actuator member for controlling pivotal movement of the control arm; and a biasing control unit that is attached at the lower end of the control arm and that controls the actuator system comprising:

a joystick;

a third actuator member including a generally spherical surface supported by spherical bearing; and a pair of proportional valves;

wherein the joystick is connected to the third actuator member and said third actuator member engages the pair of proportional valves.

9. The support apparatus of claim 8, wherein the beam is an overhead beam.

10. The support apparatus of claim 8, wherein the rotatable mounting of the beam to the stand permits motion of the beam in a horizontal plane.

11. The support apparatus of claim 8, wherein the beam is mounted to the stand at a point along the length of the beam.

12. The support apparatus of claim 8, wherein the actuator system is pneumatic.

13. The support apparatus of claim 12, wherein the actuator is a controllable piston.

14. The support apparatus of claim 8, wherein the biasing control unit comprises pilot-operated regulators and/or valves, which are coupled to a joystick and to the actuator system.

15. The support apparatus of claim 8, further comprising a generally U-shaped upright beam mounted to the rotary actuator and a pivot beam rigidly attached to the beam, the pivot beam being pivotally mounted to the generally U-shaped beam, thereby mounting the beam both rotatably and pivotally to the stand.

16. The support apparatus of claim 15, wherein the actuator system further comprises a second actuator for controlling movement of the beam relative to the generally U-shaped beam.

17. The support apparatus of claim 8, wherein the rotary actuator comprises a pair of linear actuators located on opposite sides of a bell crank, an end of each linear actuator being pivotally attached to an end of the bell crank, the other end of the bell crank being attached to a shaft rotatably mounted to the stand.

18. The support apparatus of claim 17, wherein the rotary actuator permits 45° of ration in either direction from a center position.

19. The support apparatus of claim 8, wherein the biasing control unit further comprises a pivotally mounted bracket configured to receive the blast gun.

20. The support apparatus of claim 19, wherein the bracket is configured to receive a barrel of the blast gun.

21. The support apparatus of claim 19, wherein the biasing control unit further comprises a bearing having a race attached to the proportional valves and another race attached to the joystick and the bracket.

22. The support apparatus of claim 8, wherein the joystick is connected to the actuator member by a rigid frame.

23. The support apparatus of claim 8, wherein the proportional valves are arranged orthogonally.

24. The support apparatus of claim 8, wherein each proportional valve comprises two valves that face opposite directions and a slide actuator having end members adapted to respectively engage each of the valves.

25. The support apparatus of claim 24, wherein the valves are pneumatic.

* * * * *